United States Patent [19]

Iwasawa

[11] Patent Number: 4,465,388

[45] Date of Patent: Aug. 14, 1984

[54] INK RIBBON CARTRIDGE PINCH ROLLER

[75] Inventor: Shigeru Iwasawa, Kanagawa, Japan

[73] Assignee: Bridgestone Tire Company, Limited, Tokyo, Japan

[21] Appl. No.: 409,843

[22] Filed: Aug. 20, 1982

[30] Foreign Application Priority Data

Sep. 2, 1981 [JP] Japan ..... 56-130668[U]

[51] Int. Cl.[3] ..... B41J 33/10

[52] U.S. Cl. ..... 400/196.1; 400/197; 400/202.1; 400/235.1; 29/132

[58] Field of Search ..... 400/194, 196, 196.1, 400/197, 202.1, 202.4, 207, 235.1, 636, 641; 29/132

[56] References Cited

U.S. PATENT DOCUMENTS

| | | | |
|---|---|---|---|
| 3,002,866 | 10/1961 | Gartrell et al. | 29/132 |
| 3,229,352 | 1/1966 | Balkin et al. | 29/132 |
| 3,237,433 | 3/1966 | Doleman et al. | 29/132 |
| 3,858,287 | 1/1975 | Christoffersen | 29/132 |
| 3,959,573 | 5/1976 | Eddy et al. | 29/132 |
| 4,210,403 | 7/1980 | Mazouet et al. | 400/196.1 |
| 4,289,413 | 9/1981 | Seplin | 400/196 |

FOREIGN PATENT DOCUMENTS

| | | | |
|---|---|---|---|
| 161687 | 12/1980 | Japan | 400/207 |
| 30886 | 3/1981 | Japan | 400/196.1 |
| 62182 | 5/1981 | Japan | 400/196.1 |

*Primary Examiner*—Edgar S. Burr
*Assistant Examiner*—John A. Weresh
*Attorney, Agent, or Firm*—Birch, Stewart, Kolasch & Birch

[57] ABSTRACT

An ink ribbon cartridge comprises a cartridge housing, an endless length of ink ribbon received in the housing, and a take-up roller and a pinch roller for transporting the ribbon and guiding the ribbon in a repetitively folded manner, characterized in that at least one of said take-up and pinch rollers consists of a compressed body of flexible or semi-rigid polyurethane foam. The use of compressed flexible or semi-rigid polyurethane foam results in improved rollers which have the good ribbon driving performance and driving stability.

5 Claims, 3 Drawing Figures

INK RIBBON CARTRIDGE PINCH ROLLER

BACKGROUND OF THE INVENTION

This invention relates to ink ribbon cartridges for use with dot printers or the like, and more particularly, to an improvement in take-up and pinch rollers disposed in a cartridge housing receiving an endless length of ink ribbon therein for transporting the ribbon so as to expose a minor portion of the ribbon to the outside of the cartridge and for taking the ribbon from the outside to the interior of the housing to store the ribbon in a repetitively folded manner.

Ink ribbon cartridges for use with dot printers or the like generally accommodate an endless length of ink ribbon folded in a repetitive manner within a cartridge housing. A pair of take-up and pinch rollers are disposed in the housing approximately at its take-up port. The take-up roller is driven to transport the ribbon in concert with the pinch roller. Specifically, the rollers cooperate to pull the ribbon from within the housing through its supply port, expose a minor portion of the ribbon to the outside of the housing, and return the ribbon again to the housing such that a major portion of the ribbon is accommodated in the housing in a repetitively folded manner.

More specifically, an ink ribbon cartridge comprises a cartridge housing defining a chamber therein and having supply and take-up ports at opposite ends of the chamber and an opening remote from the chamber; an endless length of ink ribbon having a major portion received in the chamber in a repetitively folded manner and a minor portion extending from the outermost fold to the innermost fold of the major folded portion and passing from the supply port to the take-up port across the opening; a take-up roller disposed at said take-up port; and a pinch roller in frictional contact with the take-up roller, the ribbon extending between the take-up and pinch rollers; whereby the take-up roller is driven to rotate in concert with the pinch roller to frictionally transport the ribbon therebetween, thereby taking the ribbon out of the chamber through the supply port and returning it into said chamber through the take-up port.

Conventional rollers are formed by injection molding solid plastic materials such as polyamide resins and optionally, indenting the circumferential surface. Some plastic rollers of this type are inexpensive, high in dimensional accuracy, and free of problems such as temperature-variable performance and shape, and deterioration by ink. However, in rollers of this type, the adherence of ink to the roller surface often causes slippage of the ribbon being frictionally driven, and in addition, only a reduced length of ribbon can be received in the housing because of the reduced length of each fold or turn of the major folded portion. Ribbon cartridges for use with dot printers are required to house a maximum length of ribbon in a given cartridge chamber volume by the repeated folding of the ribbon. The drawback of the plastic molded rollers that the reduced length of each fold of the major folded portion limits the overall length of ribbon received in the housing is unacceptable for such ribbon cartridges. At present, rollers of NBR (acrylonitrile-butadiene rubber) are used as a substitute for the plastic molded rollers.

The solid NBR rollers allow the length of each fold of a major folded portion of ribbon to be increased, increasing the overall length of ribbon received and extending the life of the cartridge. These rollers, however, have poor temperature properties, and particularly, the rubber elasticity is drastically diminished at low temperatures, causing uneven ribbon transport and slippage. They can therefore be used only in a limited temperature range. Furthermore, since NBR has poor oil resistance, the NBR rollers tend to swell up with ink and deformed at the ribbon contacting area. A further shortcoming is that NBR rollers are uneven in quality because of variations in hardness and working dimensions developing during manufacturing. Such unevenness is detrimental to the driving of the ribbon.

Other materials of which rollers may be made include sponge rubber materials of urethane rubber, NBR, and polyvinyl chloride. Rollers of spongy NBR have drawbacks similar to those of the above-mentioned solid NBR rollers. Unevenness in quality is further magnified by the expansion of NBR into sponge. Rollers of spongy polyvinyl chloride have poor temperature properties, and are liable to deterioration on account of migration of a plasticizer from the polyvinyl chloride to ink or migration of ink to the polyvinyl chloride. They are also uneven in quality. Rollers of spongy polyurethane rubber are subject to distortion or strain under applied loads, causing them to drive the ribbon in an unstable manner. Furthermore, rollers formed from closed-cell spongy urethane rubber by casting have reduced dimensional stability, and are substantially nonuniform in cell distribution, weight and hardness. The use of the cast urethane rubber rollers is still unsatisfactory in ribbon driving because the ribbon tends to shift towards one side or the other of the rollers as it is being driven. On the other hand, sintered spongy urethane rubber having interconnecting cells is also nonuniform in weight and hardness because of the varying amount of particulate material or powder charged for a batch. Like the cast urethane rubber rollers, rollers of the sintered urethane rubber also perform unsatisfactorily in ribbon driving. In addition, the sintered spongy urethane rubber is readily damaged because of its reduced strength. Furthermore, these spongy urethane rubbers are generally thermoplastic and thus have undesirable temperature properties. They exhibit increased hardness at low temperatures. Thus, rollers made of this type of spongy urethane rubber become unstable when driving the ribbon at low temperatures. The use of thermosetting spongy urethane rubbers cannot ensure stable ribbon driving because they are nonuniform in cell distribution. None of the spongy urethane rubbers are fully satisfactory with respect to ribbon driving, particularly stable ribbon driving.

SUMMARY OF THE INVENTION

The present invention aims at eliminating the problems of the above-described rollers. The inventors have achieved an improvement in ribbon driving in an ink ribbon cartridge of the type wherein take-up and pinch rollers function to transport an endless length of ink ribbon such that a major portion of the ribbon is received within a cartridge housing in a repetitively folded manner, based on the finding that by making the rollers from a compressed flexible or semi-rigid polyurethane foam, the rollers may be protected from distortion under applied loads, variations in weight, hardness and working dimensions may be minimized to ensure uniform quality and high dimensional accuracy, deterioration by ink is precluded, and temperature properties are improved, with hardness remaining substantially constant over a temperature range between −5° C. and 60° C.

Therefore, an object of the present invention is to provide an ink ribbon cartridge with enhanced ribbon driving performance and driving stability of the take-up and pinch rollers.

According to the present invention, there is provided an ink ribbon cartridge which comprises a cartridge housing, an endless length of ink ribbon received in the housing, and a take-up roller and a pinch roller for transporting the ribbon and guiding the ribbon in a repetitively folded manner, characterized in that at least one of the take-up and pinch rollers consists of a compressed body of flexible or semi-rigid polyurethane foam. The use of compressed flexible or semi-rigid polyurethane foam results in improved rollers which are not substantially distorted under applied loads, or uniform in quality and free of variations in weight, hardness and working dimensions, and have improved dimensional accuracy and oil resistance as well as improved temperature properties. These advantages all contribute to improvements in the ribbon driving performance and driving stability of the rollers.

BRIEF DESCRIPTION OF THE DRAWINGS

The above and other objects, features and advantages of the present invention will be more fully understood by reading the following description in conjunction with the accompanying drawings, in which.

DESCRIPTION OF THE PREFERRED EMBODIMENT

Figure 1:
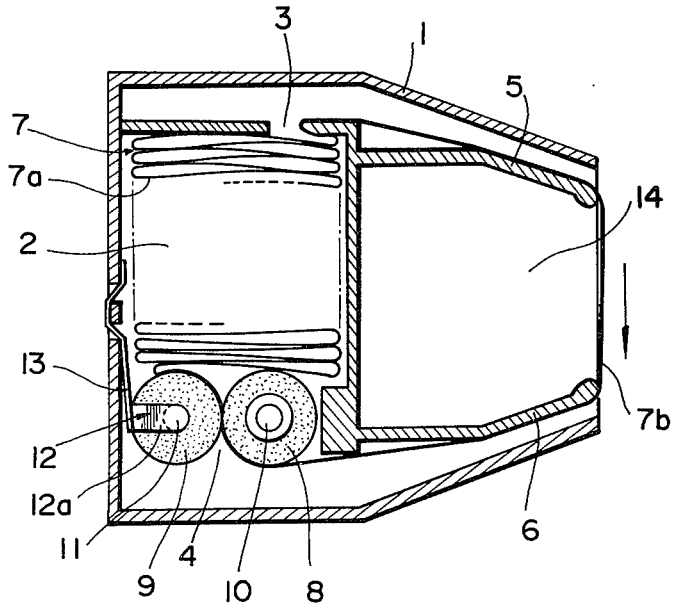
FIG. 1 is a plan view of one embodiment of the ink ribbon cartridge of the present invention with the top wall cut away.
Figure 2:
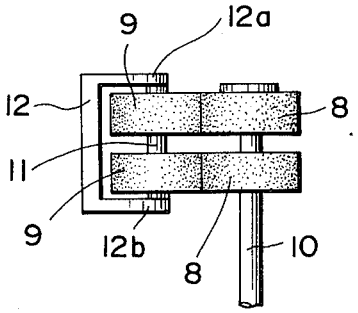
FIG. 2 is an elevation showing the take-up and pinch rollers used in the cartridge of FIG. 1.

FIG. 1 illustrates one embodiment of the ink ribbon cartridge of the present invention. The cartridge comprises a cartridge housing 1 which defines a chamber 2 therein and has supply and take-up ports 3 and 4 at opposite ends of the chamber 2 and two guide arms 5 and 6 separated by an opening remote from the chamber 2. An endless length of ink ribbon 7 has a major portion 7*a* received in the chamber 2 in a repetitively folded manner and a minor portion 7*b* extending from the outermost fold to the innermost fold of the major folded portion 7*a* and passing from the supply port 3 to the take-up port 4 across the opening where the minor portion 7*b* is exposed to the outside of the housing 1. Disposed at the take-up port 4 of the chamber 2 are a pair of take-up and pinch rollers 8 and 9 in frictional contact. As seen from FIG. 2, the take-up roller 8 has a shaft 10 which is geared to a suitable drive mechanism (not shown) such that the take-up roller 8 is rotated clockwise (viewed in FIG. 1) by the drive. The pinch roller 9 has another shaft 11 which is journalled between arms 12*a* and 12*b* of a support channel 12. The support channel 12 is secured to a leaf spring 13 which is attached to the housing 1. The leaf spring 13 biases the support channel 12 toward the take-up roller 8 to force the pinch roller 9 in contact with the take-up roller 8 with the ribbon 7 interposed therebetween. The frictional contact with the take-up roller 8 causes the pinch roller 9 to rotate in concert therewith, affording the transport of the ribbon 7 in the direction shown by the arrow in FIG. 1. Although each of the take-up and pinch rollers 8 and 9 consists of two roller segments in FIG. 2, each roll may consist of a single roller or three or more roller segments mounted on a common axis at equal intervals.

The ink ribbon cartridge is designed such that the take-up roller 8 is rotated by a suitable drive mechanism which comes in driving connection with the shaft 10 when the cartridge is set in place. As the pinch roller 9 is rotated with the take-up roller 8, the ribbon 7 interposed between the oppositely rotating rollers 8 and 9 is continuously transported. The cooperating take-up roller 8 and pinch roller 9 function to take the minor portion of ribbon 7*b* out of the chamber 2 through the supply port 3 to expose it on the cartridge outside over the opening between the two guide arms 5 and 6, and to return the ribbon 7 into the chamber 2 so as to compactly store the ribbon 7 in a repetitively folded manner in the chamber 2 by traversing it.

In service, the ink ribbon cartridge is set in a dot printer such that a printing needle assembly is positioned in a portion 14 defined between the two guide arms 5 and 6 of the housing 1. The exposed portion 7*b* of ribbon 7 is adjacent a platen with a sheet of paper interposed therebetween. Selected printing needles of the needle assembly strike the paper through the ink ribbon to transfer ink from the ribbon to the paper, thereby achieving printing.

In the ink ribbon cartridge of the above-mentioned arrangement, the take-up and pinch rollers 8 and 9 are compressed bodies of flexible or semi-rigid polyurethane foam according to this invention. The rollers of compressed flexible or semi-rigid polyurethane foam exhibit improved performance over conventional rollers. The rollers of compressed flexible or semi-rigid polyurethane foam allow the length of each fold to be increased when the major portion of ribbon is folded and received in the chamber, thus increasing the overall length of ribbon that may be received in the chamber. These rollers are substantially free of variation in weight, hardness and working dimensions, and are thus uniform and consistent in quality both in a single roller and among a number of rollers. Such problems as swelling by ink absorption are eliminated because of improved oil resistance. Hardness varies only slightly with temperature, and particularly hardness properties remain substantially unchanged over the ordinary service temperature range between −5° C. and 60° C. The rollers are not distorted substantially under an applied load, which obviates any inconvenience associated with ribbon transport including slippage, irregular feed, deformation of the contact area, and lateral shift of the ribbon. These features enable the ribbon to be transported in a smooth, stable, and constant manner over a wide temperature range. The rollers of compressed flexible or semi-rigid polyurethane foam have a further advantage in that their uniform cells form a uniform roller surface that provides for minimum variability in driving resistance during ribbon transport. This also contributes to stable driving.

The preferred compressed bodies for the rollers are made from a flexible polyurethane foam having a cell membrane-free three dimensional reticulated or skeletonized structure. The flexible polyurethane foam having a cell membrane-free reticulated structure may be prepared by subjecting a cell membrane-bearing flexible polyurethane foam to a heat or chemical treatment to remove the cell membranes, or by starting from a specific compound formulated to form a cell membrane-free foam.

Figure 3:
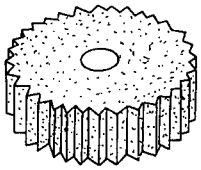
FIG. 3 is a perspective view showing another example of the roller.

Although the polyurethane foams may be polyether polyurethane foams, polyester polyurethane foams are preferred because of their properties, for example, excellent oil resistance. The flexible or semi-rigid polyurethane foams from which the compressed bodies are formed are not particularly limited in cell number, but foams having 40 to 90 cells per inch are preferred. The process of producing a compressed body from a flexible or semi-rigid polyurethane foam is not particularly limited, but heat compression is generally employed. Compression ratio is not limited, but preferably ranges from 75% to 95%. Compression is preferably carried out such that the resulting compressed bodies have a density ranging from 0.15 g/cm$^3$ to 0.65 g/cm$^3$, and a surface hardness ranging from 10 to 60 in Shore A hardness, and more preferably from 30 to 50 in Shore A hardness. Best results are obtained from compressed foam bodies having a cell number, compression rate, density, and surface hardness within the above ranges. When rollers are obtained from a relatively large compressed body of flexible or semi-rigid polyurethane foam by punching or cutting, care should be taken to ensure uniform quality such that the direction of compression of a piece cut from the compressed body is aligned with the axis of the roller. The compressed body or roller may be indented on its circumferential surface as shown in FIG. 3.

In the above-mentioned preferred embodiment, both the take-up and pinch rollers are made of a compressed flexible or semi-rigid polyurethane foam. According to the present invention, either the take-up roller or the pinch roller may be made of a compressed flexible or semi-rigid polyurethane foam. When the take-up and pinch rollers each consist of a plurality of roller segments, at least one, and preferably all the roller segments may be made of a compressed flexible or semi-rigid polyurethane foam.

Furthermore, the take-up and pinch rollers of compressed polyurethane foam may be impregnated with ink, permitting the rollers to have an additional function as ink applicator to the ribbon. The effective life of an ink ribbon cartridge may be increased by impregnating the take-up and pinch rollers with ink, thereby providing these with an inking roller function. The incorporation of a separate ink applicator would increase cartridge size, but rollers serving the dual functions of ribbon take-up and inking enable a compact cartridge.

It is further understood by those skilled in the art that the foregoing description is a preferred embodiment and that various changes and modifications may be made in the invention without departing from the spirit and scope thereof.

What is claimed is:

1. An ink ribbon cartridge comprising in combination: a cartridge housing defining a first chamber therein for storing in a folded manner an endless ink ribbon having supply and take-up ports at opposite ends of said chamber and a second chamber for housing a printing mechanism juxtapositioned to said first chamber having an opening therein remote from said first chamber, said ink ribbon extending from said supply port to said take-up port across said opening of said second chamber;

a take-up roller disposed at said take-up port; and a pinch roller in frictional contact with said take-up roller with said ribbon passing between said take-up roller and said pinch roller such that when said take-up roller is driven to rotate in concert with said pinch roller to frictionally transport said endless ribbon therebetween, said ribbon is drawn out of said first chamber through said supply port and returned to said first chamber through said take-up port, characterized in that at least one of said take-up roller and pinch roller consists of a compressed body of flexible polyurethane foam, having a cell membrane-free three-dimensional reticulated structure, said compressed body being prepared by compressing said foam having 40 to 90 cells per inch at a compression ratio of 75 to 95% with the direction of the compression of said compressed body being aligned with the axis of the roller, said compressed body having a density of 0.15 to 0.65 g/cm$^3$ and a Shore A hardness of 10 to 60.

2. The ribbon cartridge as defined in claim 1, wherein said second chamber is defined by two guide arms which direct said endless ribbon across said opening of said second chamber.

3. The ribbon cartridge as defined in claim 1 wherein each of said take-up and pinch rollers consists of a compressed body of flexible polyurethane foam.

4. The ribbon cartridge as defined in claim 1 wherein said compressed body is impregnated with ink.

5. The ribbon cartridge as defined in claim 1 wherein each of said take-up and pinch rollers is indented on the circumferential surface.

* * * * *